US006074241A

United States Patent [19]

Patel et al.

[11] Patent Number: 6,074,241

[45] Date of Patent: Jun. 13, 2000

[54] NON-SLIP SPRING CLAMP CONTACT

[75] Inventors: Navin Kanjibhai Patel, Hummelstown; William Cheng Ouyang, Harrisburg; Robert Scott Good, Camphill, all of Pa.

[73] Assignee: The Whitaker Corporation, Wilmington, Del.

[21] Appl. No.: 09/092,473

[22] Filed: Jun. 5, 1998

[51] Int. Cl.[7] ..... H01R 4/24

[52] U.S. Cl. ..... 439/441; 439/709; 439/1

[58] Field of Search ..... 439/709, 728, 439/729, 417, 441, 812, 79, 95, 813

[56] References Cited

U.S. PATENT DOCUMENTS

| | | | |
|---|---|---|---|
| 3,867,004 | 2/1975 | Komorowski et al. | 339/95 |
| 3,945,711 | 3/1976 | Hohorst et al. | 339/95 D |
| 4,576,429 | 3/1986 | Haroduin et al. | 339/95 D |
| 4,701,138 | 10/1987 | Key | 439/417 |
| 4,767,340 | 8/1988 | Hohorst | 439/729 |
| 5,015,201 | 5/1991 | Brezee et al. | 439/441 |
| 5,292,260 | 3/1994 | Sinisi et al. | 439/441 |
| 5,292,263 | 3/1994 | Mosser et al. | 439/812 |
| 5,324,213 | 6/1994 | Frantz | 439/441 |
| 5,445,528 | 8/1995 | Frantz | 439/79 |
| 5,580,286 | 12/1996 | Kramer et al. | 439/813 |
| 5,588,880 | 12/1996 | Wood | 439/709 |
| 5,588,881 | 12/1996 | Eggert et al. | 439/709 |
| 5,685,735 | 11/1997 | Hohorst | 430/441 |
| 5,729,442 | 3/1998 | Frantz | 361/823 |

FOREIGN PATENT DOCUMENTS

| | | | |
|---|---|---|---|
| 44 09 206 C1 | 5/1995 | Germany | H01R 9/26 |
| 195 15 358 A1 | 12/1995 | Germany | H01R 9/26 |

*Primary Examiner*—Gary F. Paumen
*Assistant Examiner*—Alexander Gilman

[57] ABSTRACT

The present invention is directed to an electrical connector 10 having a housing 12 with at least one electrical contact 22 positioned therein. The electrical contact 22 is adapted for electrical engagement with an electrical wire 42 to be positioned within the housing 12. A spring 16 has a fixed end 17 and a free end 18, the fixed end 17 of the spring 16 is used to secure the spring 16 in the housing 12. The free end 18 of the spring 16 is positioned adjacent a tool opening 20 formed in the housing 12. The free end 18 of the spring 16 is adapted to be directly engaged by a tool 13 to be inserted through the tool opening 20 in the housing 12. The free end 18 of the spring 16 further comprises a plurality of retention tabs 35, 36, 37 formed thereon that are adapted for engaging the tool 13 when the tool 13 is inserted into the housing 12 to deflect the spring 16 and thereby allow the insertion of an electrical wire 42 into the connector 10 adjacent the electrical contact 22.

24 Claims, 5 Drawing Sheets

NON-SLIP SPRING CLAMP CONTACT

BACKGROUND OF THE INVENTION

1. Field of the Invention

The present invention is generally related to an electrical connector and, more particularly, to a spring clamp contact useful in making electrical connectors.

2. Description of the Related Art

There are many techniques and means for connecting electrical wires or conductors to various electrical devices. One such means is a spring clamp contact which may be comprised of a spring and a contact member. In such devices, the spring is deflected to allow an electrical wire to be inserted between the deflected spring and the contact member. When the spring is released, it tends to return to its pre-deflection position, thereby trapping and securing the electrical wire against the contact member.

The deflection of the spring in such conductors may be accomplished by a variety of techniques. One technique involves the use of a tool, such as a screwdriver, to deflect the spring and allow insertion of an electrical wire between the deflected spring and a contact member. The spring is then released, thereby securing the electrical wire against the contact member.

However, in these type of connectors, there are one or more intermediate parts positioned between the spring and the tool used to ultimately cause the spring to be deflected. The use of such intermediate part(s) is problematic in that it requires more parts and may increase the cost and time required to manufacture and assemble a connector. Moreover, the use of additional parts may cause problems if the intermediate part breaks or does not properly engage the spring when the tool is pressed against the intermediate part.

Additionally, in using these type of connectors, it is important that the tool used to deflect the spring, for example, a screwdriver, be prevented from slipping off of the spring as the spring is being deflected. If the tool used to deflect the spring slips off of the spring, it may become lodged or trapped between the partially deflected spring and the housing of the connector. Such occurrences can result in damage to the spring, the contact and the housing, either when the tool slips off or when attempts are made to withdraw the trapped tool. If the tool is not prevented from slipping off the spring as it is depressed, workers installing the electrical wires into the connector will have to take other steps to attempt to insure that the tool does not slip off of the spring as it is being deflected. For example, the workers may be able to slightly manipulate the angle of the tool with respect to the spring as the spring is being deflected. Whatever techniques may be employed by workers to attempt to prevent the tool from slipping off the spring, it will likely require more time to install the electrical wires into the conductor than would be required if a spring clamp contact has a mechanism to prevent the tool from slipping off the spring in the first place.

The present invention is directed to a connector that solves or reduces some or all of the aforementioned problems.

SUMMARY OF THE INVENTION

The present invention is directed to an electrical connector having a housing with at least one contact positioned within the housing. The contact is adapted for electrical coupling to an electrical wire to be positioned in the housing. The invention further comprises at least one spring for urging the electrical wire into engagement with the contact in the housing. The spring is comprised of a fixed end and a free end. The fixed end of the spring is used to secure the spring within the housing. The free end of the spring is positioned adjacent a tool opening formed in the housing. The free end of the spring is adapted to be directly engaged by a tool inserted through the tool opening formed in the housing. The free end of the spring may further comprise at least one retention tab positioned thereon that is adapted for engaging the tool and preventing it from slipping off of the free end of the spring.

BRIEF DESCRIPTION OF THE DRAWINGS

The invention may be understood by reference to the following description taken in conjunction with the accompanying drawings, in which like reference numerals identify like elements, and in which.

Figure 1:
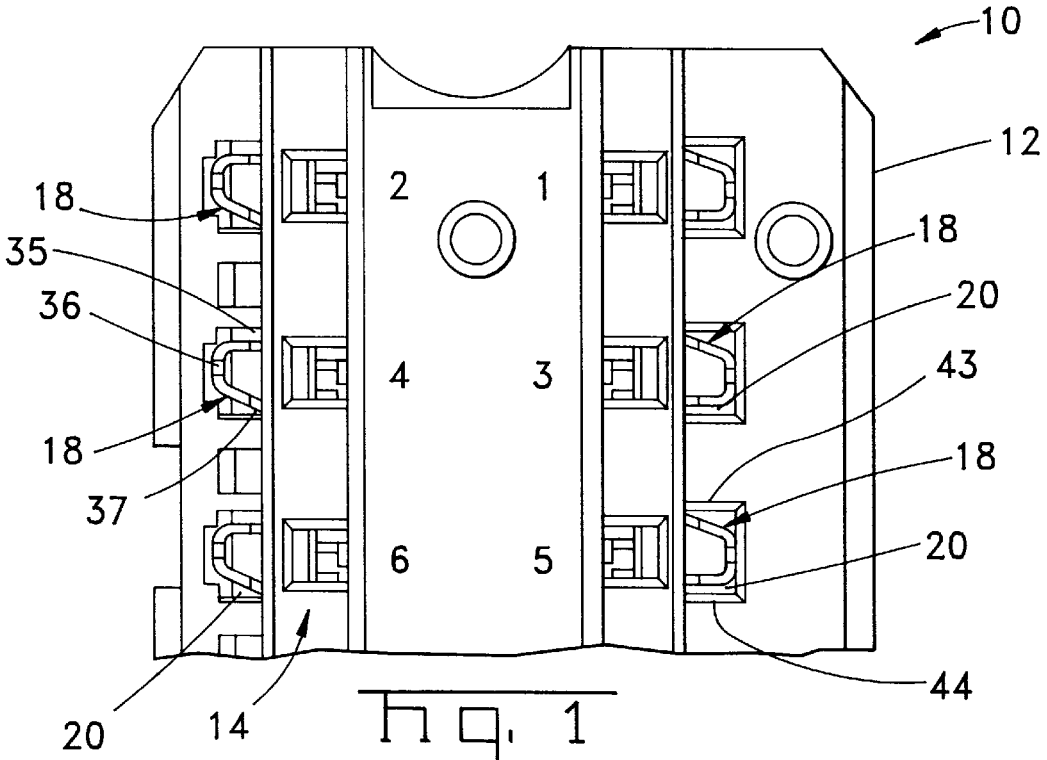
FIG. 1 is a top view of an electrical connector employing one illustrative embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
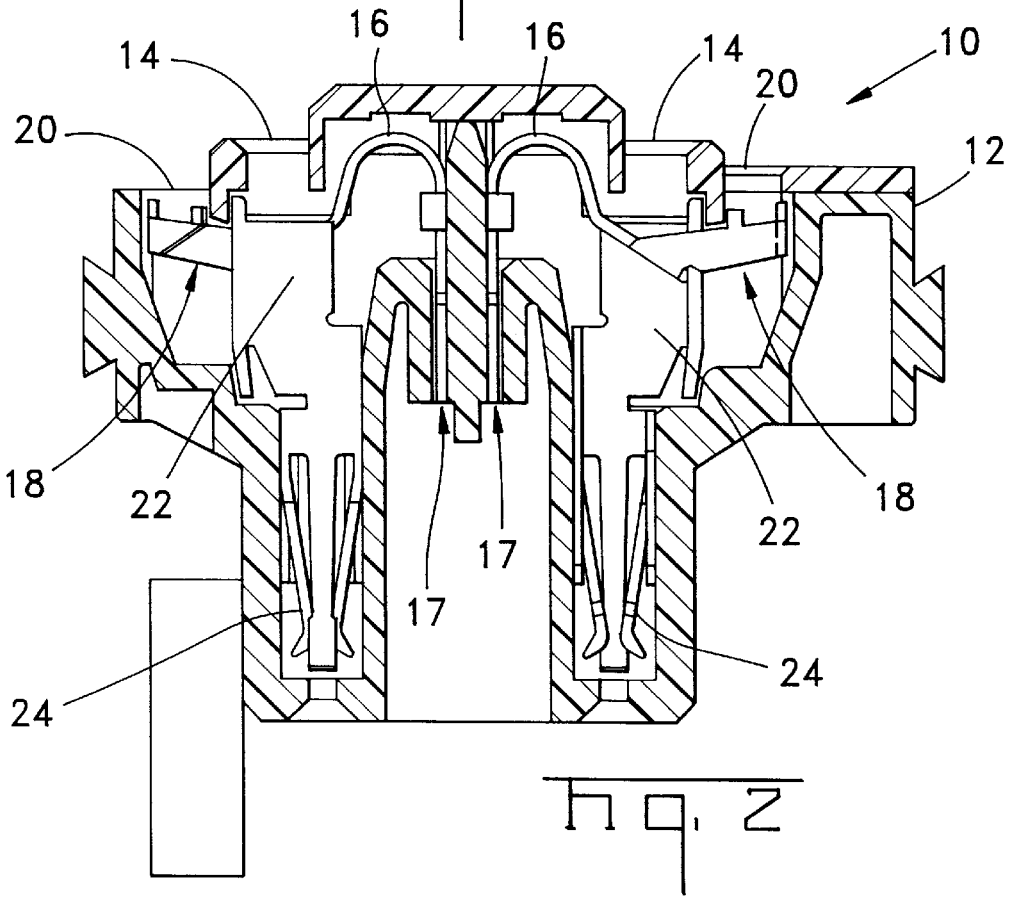
FIG. 2 is a cross-sectional side view of the device shown in FIG. 1.

As shown in FIGS. 1 and 2, an electrical connector 10 is comprised of a housing 12 having a plurality of tool openings 20 and a plurality of conductor or wire recurring openings 14. As will be apparent to those skilled in the art, electrical wires (not shown) may be installed in the connector 10 through the conductor openings 14. The connector 10 may further comprise a plurality of springs 16, each having a free end 18, and a plurality of electrical contacts 22 with receptacles 24 formed thereon. The receptacles 24 in the connector 10 are adapted to mate with corresponding pins (not shown) in a mating connector half (not shown).

The free ends 18 of the springs 16 are positioned adjacent the tool openings 20 formed in the housing 12.

The tool openings 20 allow for the insertion of a tool 13, for example, a screwdriver (see FIGS. 6, 7 and 8), into the housing 12. As will be discussed more fully below, the tool 13 may be inserted through the tool opening 20 and directly engage the free end 18 of the spring 16, thereby deflecting the spring 16 from its normal position shown in FIG. 2 to its deflected position shown in FIG. 7. There are no intermediate parts positioned between the tool 13, e.g., a screwdriver, and the free end 18 of the spring 16. Thus, the present connector 10 has an unobstructed path that allows the tool 13 to directly engage the free end 18 of the spring 16.

Figure 3:
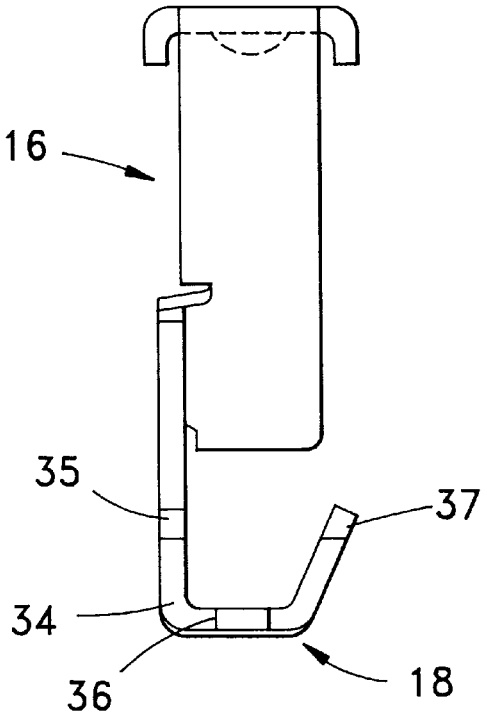
FIG. 3 is a top view of a spring employing one illustrative embodiment of the present invention.
Figure 5:
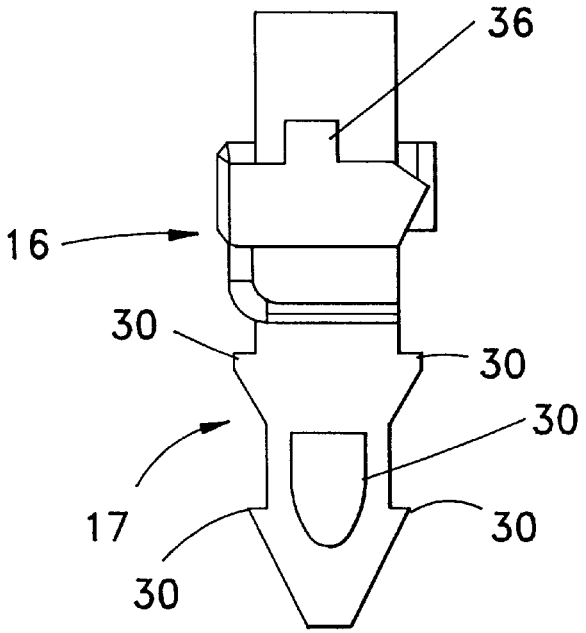
FIG. 5 is an end side view of the device shown in FIG. 3.
Figure 4:
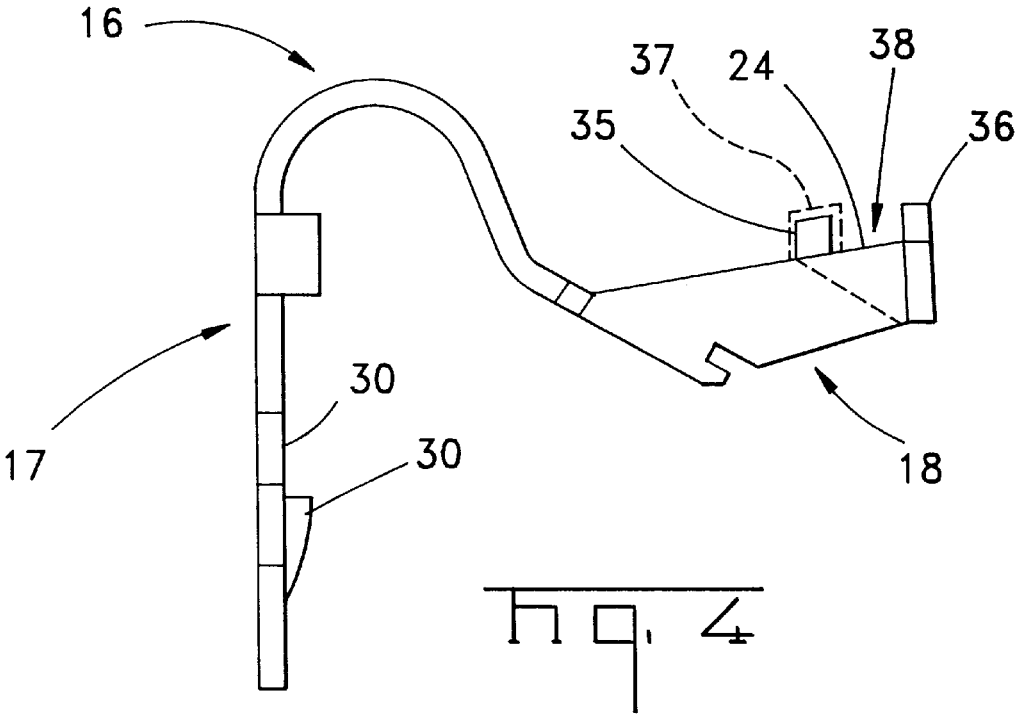
FIG. 4 is a side view of the device shown in FIG. 3.

One illustrative embodiment of the present invention is shown in FIGS. 3, 4 and 5. The illustrative spring 16 is comprised of a free end 18 and a fixed end 17. A plurality of mounting barbs 30 are positioned on the fixed end 17 of the spring 16. The mounting barbs 30 are used to secure the spring 16 into the housing 12 of the connector 10. The spring 16 may be secured to the housing 12 by a variety of techniques readily known to those skilled in the art. If desired or necessary for a particular application, the free end 18 of the spring 16 may further comprise a plurality of retention tabs 35, 36, 37 positioned thereon. In one illustrative embodiment, the retention tabs 35, 36, 37 are made so as to project upwardly from a surface 34 of the free end 18, and the retention tabs 35, 36, 37 are generally rectangular in cross-section. However, as is readily apparent to those skilled in the art, the number, size, shape and positioning of the retention tabs 35, 36, 37, as well as the decision as to whether they are required at all, are matters of design choice. Thus, the present invention should not be considered to be limited to the precise configuration of the illustrative embodiments shown in the drawings.

In the illustrative embodiment of the spring 16 shown in FIGS. 3, 4 and 5, the retention tabs 35, 36, 37 are configured so as to define a retention slot 38 on the free end 18 of the spring 16. In the illustrative embodiment of the invention shown in FIGS. 3, 4 and 5, the retention slot 38 is formed by locating the retention tab 36 farther from the longitudinal axis of the connector 10 than are the retention tabs 35 and 37. The retention slot 38 is adapted to receive the end of a tool 13, for example, a screwdriver, that will be used to deflect the spring 16 to allow insertion of an electrical wire 42 (see FIG. 6) into the connector 10. In one illustrative embodiment, the retention slot 38 is approximately 2.5 mm wide, the retention tab 36 extends approximately 0.75 mm above the surface 34 of the free end 18 of the spring 16, and the retention tabs 35 and 37 extend approximately 0.65 mm above the surface 34 of the free end 18 of the spring 16. The height of the retention tabs 35, 36, 37 may range from approximately 0.2 mm to 0.8 mm.

Of course, as will be readily apparent to those skilled in the art, the number, configuration and location of the retention tabs 35, 36, 37, as well as the width of the slot 38 and height of the retention tabs 35, 36, 37, are matters of design choice that may vary depending on a number of factors. For example, although three retention tabs 35, 36, 37 are depicted in the drawings, only one retention tab may be necessary to prevent the tool 13 from becoming disengaged from the free end 18 of the spring 16. Additionally, if it is anticipated that very large tools will be used to deflect the spring 16, then the width of the retention slot 38 as well as the height, thickness and width of the retention tabs 35, 36, 37 may have to be increased.

Figure 6:
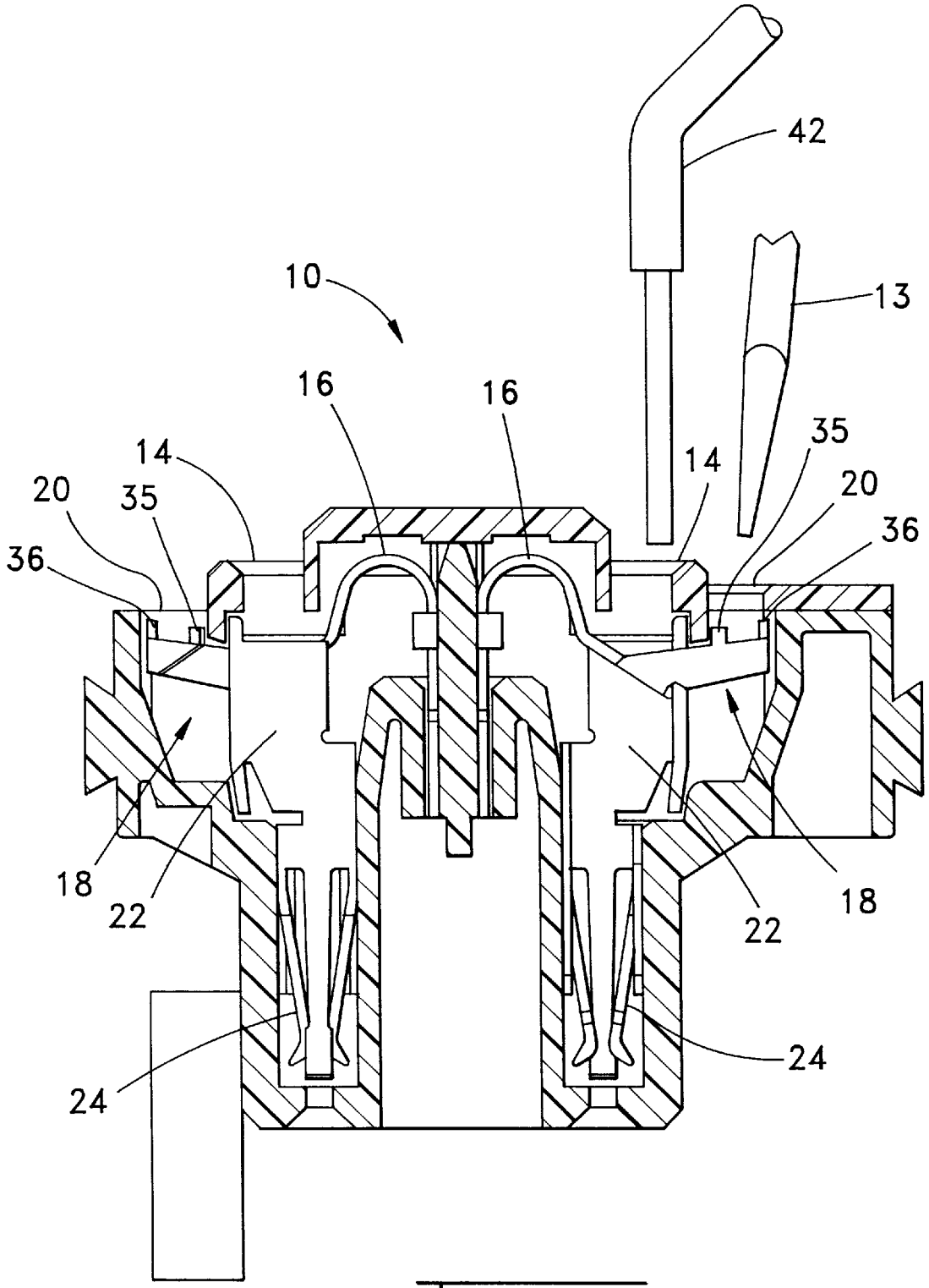
FIG. 6 is a cross-sectional view of a connector employing one illustrative embodiment of the present invention prior to the insertion of an electrical wire into the connector.

The use of the present invention will now be described with reference to FIGS. 6–8. FIG. 6 depicts the connector 10 with the spring 16 in its normal, non-deflected position. An illustrative electrical wire 42 is positioned above the conductor opening 14 in the housing 12 for insertion into the connector 10. Similarly, a tool 13, e.g., a screwdriver, is positioned above the tool opening 20 in the housing 12 and it will be used to deflect the free end 18 of the spring 16 (discussed more fully below).

Figure 7:
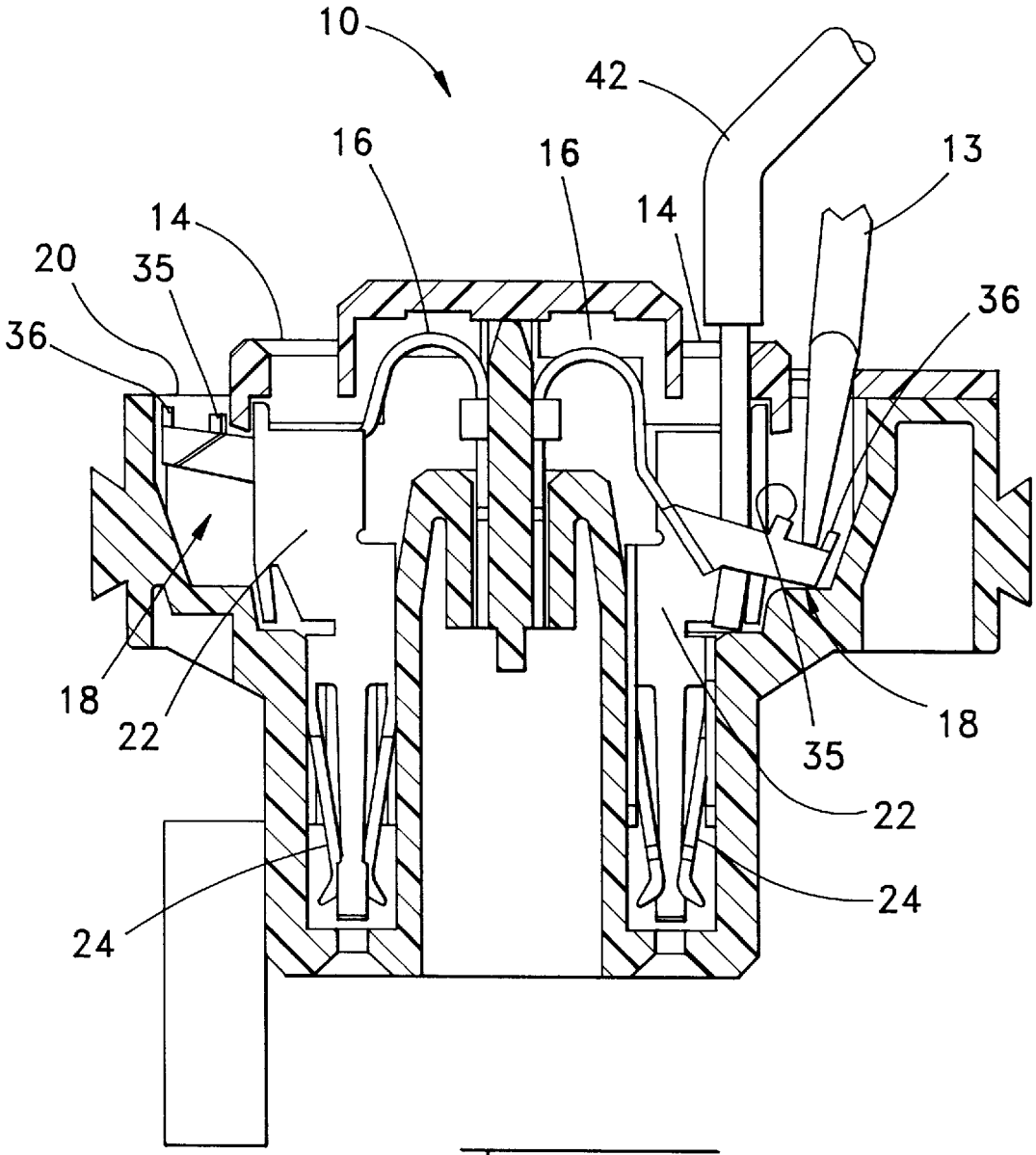
FIG. 7 is a cross-sectional view of a connector employing one illustrative embodiment of the present invention with the spring deflected by a tool and an electrical wire positioned within the connector.

As shown in FIG. 7, the spring 16 has been moved to its deflected position by the tool 13 that is directly engaged with the free end 18 of the spring 16, i.e., the tool 16 is positioned in the retention slot 38 on the free end 18 of the spring 16. There are no intermediate parts or members positioned between the tool 13 and the free end 18 of the spring 16. Thus, the connector 10 provides an unobstructed path that allows the tool 13 to directly engage the free end 18 of the spring 16. Allowing the tool 13 to directly engage the spring 16 is desirable because, among other things, it eliminates problems that may arise if an intermediate part were positioned between the tool 13 and the spring 16. For example, an intermediate part positioned between the tool 13 and the spring 16 might become jammed or break. In contrast, by allowing the spring 16 to be directly engaged by the tool 13, the chances of such problems occurring are eliminated.

The electrical wire 42 is shown after it has been inserted into the connector 10 through the conductor opening 14 in the housing 12. As is readily apparent, the retention tabs 35, 36, 37 act to prevent the tool 13 from slipping out of engagement with the free end 18 of the spring 16 during the process of deflecting the free end 18 of the spring 16. The sides 43 and 44 of the housing 12 surrounding the free end 18 of the spring 16 (see FIG. 1) also act to prevent the tool 13 from moving laterally with respect to the spring end 18.

Figure 8:
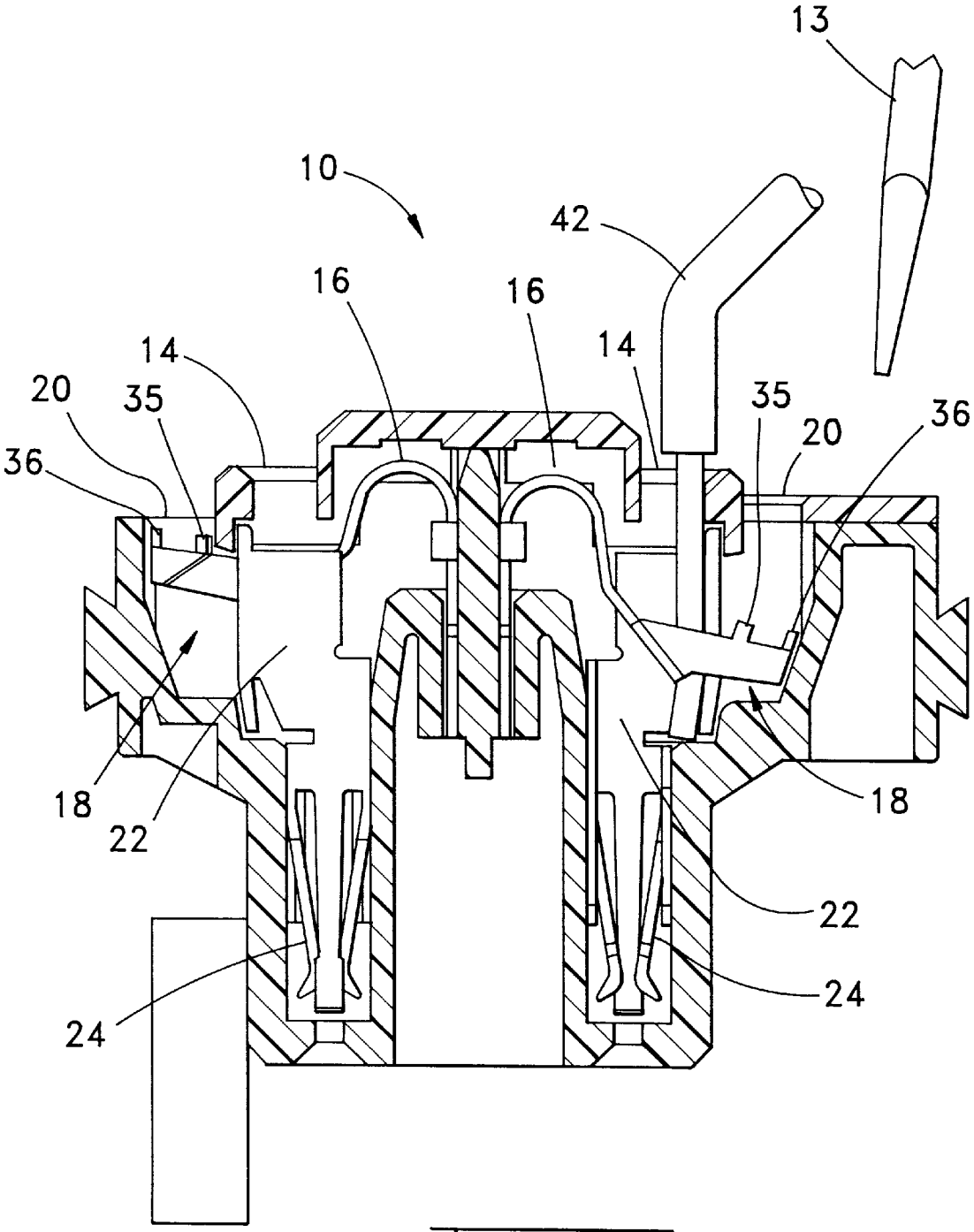
FIG. 8 is a cross-sectional view of a connector employing one illustrative embodiment of the present invention depicting the electrical wire in its final, installed position after the spring has been released.

As shown in FIG. 8, the tool 13 has been withdrawn from the tool opening 20 in the housing 12, and the spring 16 has trapped the electrical wire 42 against the electrical contact 22 positioned within the housing 12.

The present invention provides a quick and efficient means of establishing electrical connections within a connector. The present invention allows a spring deflecting tool, e.g., a screwdriver, to directly engage the spring and deflect it from its normal position. Moreover, the present invention is effective at preventing the deflecting tool, e.g., a screwdriver, from becoming disengaged with the free end of the spring clamp contact as the spring is being deflected and during subsequent release operations. By insuring that the tool may directly engage the spring, and that the tool does not become disengaged from the free end of the spring, the present invention helps to prevent or reduce many problems such as the tool becoming lodged against the connector housing. Additionally, the present invention may be used with a solid wire or stranded wire conductor.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An electrical connector, comprising:

a housing having a wire receiving face, at least one wire receiving opening and at least one tool opening formed in the wire receiving face;

at least one contact positioned within said housing, said contact adapted for being electrically engaged to an electrical wire to be inserted into said housing through said at least one wire receiving opening; and at least one spring housed in said housing for urging said electrical wire into engagement with said contact, said spring having a fixed end for securing said spring within said housing and a free end, the free end having a tool engagement surface residing in a plane generally parallel to the wire receiving face prior to insertion of the wire and a retention tab extending from the engagement surface towards the tool opening;

said free end of said spring being positioned adjacent said at least one tool opening in said housing, said free end of said spring adapted for direct engagement with a tool to be inserted into said housing through said at lest one tool opening, said tool being adapted to deflect said spring to permit engagement of said wire with said contact.

2. The electrical connector of claim 1, wherein said at least one retention tab is rectangular in cross-section.

3. The electrical connector of claim 1, wherein said at least one retention tab extends from the engagement surface and toward the wire receiving opening a distance ranging from approximately 0.2 to 0.8 millimeters.

4. The electrical connector of claim 1 wherein said housing includes a plurality of wire receiving openings and a plurality of tool openings formed therein.

5. The electrical connector of claim 1, further comprising at least three retention tabs positioned on said free end of said spring.

6. The electrical connector of claim 4, wherein said housing has a longitudinal axis and at least two of said at least three retention tabs are positioned closer to said longitudinal axis of said connector than the other of said at least three retention tabs.

7. The electrical connector of claim 1, further comprising a plurality of retention tabs positioned on said free end of said spring.

8. The electrical connector of claim 3, wherein said housing has a longitudinal axis and at least one of said plurality of retention tabs is positioned closer to said longitudinal axis of said connector than the other of said plurality of retention tabs.

9. The electrical connector of claim 3, wherein said housing has a longitudinal axis and at least one of said plurality of retention tabs is positioned farther from said longitudinal axis of said connector than the other of said plurality of retention tabs.

10. An electrical connector, comprising:

a housing having at least one wire receiving opening formed therein;

at least one contact positioned within said housing, said contact adapted for being electrically engaged to an electrical wire to be inserted into said housing through said at least one wire receiving opening;

at least one spring for urging said electrical wire into engagement with said contact, said spring having a fixed end for securing said spring within said housing and a free end, the free end having a tool engagement surface residing in a plane generally parallel to the wire receiving opening prior to insertion of the wire and at least one retention tab extending from the engagement surface towards the wire receiving opening, said retention tab adapted for engaging a tool to be inserted into said housing to deflect said spring to permit engagement of said wire with said contact.

11. The electrical connector of claim 10, wherein said housing further comprises at least one tool opening formed therein, and said free end of said spring is positioned adjacent said at least one tool opening in said housing, said free end of said spring adapted for direct engagement with a tool to be inserted through said at least one tool opening in said housing.

12. The electrical connector of claim 10, wherein said at least one retention tab is rectangular in cross-section.

13. The electrical connector of claim 10, wherein said at least one retention tab extends from the engagement surface and toward the wire receiving opening a distance ranging from approximately 0.2 to 0.8 millimeters.

14. The electrical connector of claim 10 wherein said housing includes a plurality of wire receiving openings and a plurality of tool openings formed therein.

15. The electrical connector of claim 10, wherein said at least one retention tab comprises at least two retention tabs.

16. The electrical connector of claim 15, wherein said housing has a longitudinal axis and at least one of said at least two retention tabs is positioned closer to said longitudinal axis of said connector than the other of said at least two retention tabs.

17. The electrical connector of claim 15, wherein said housing has a longitudinal axis and at least one of said at least two retention tabs is positioned farther from said longitudinal axis of said connector than the other of said at least two retention tabs.

18. An electrical connector, comprising:

a housing, said housing having a wire receiving face, at least one wire receiving opening and at least one tool opening formed in the wire receiving face;

at least one contact positioned within said housing, said contact adapted for being electrically engaged to an electrical wire to be inserted into said housing through said at least one wire receiving opening; and at least one spring housed in said housing for urging said electrical wire into engagement with said contact, said spring having a fixed end for securing said spring within said housing and a free end said free end of said spring being positioned adjacent said at least one tool opening in said housing and having a tool engagement surface residing in a plane generally parallel to the wire receiving face prior to insertion of the wire and a plurality of retention tabs extending from the engagement surface towards the tool opening, said retention tabs adapted for engaging a tool to be inserted through said at least one tool opening in said housing, said tool being adapted to deflect said spring to permit engagement of said wire with said contact.

19. The electrical connector of claim 18, wherein said plurality of retention tabs is comprised of at least two retention tabs.

20. The electrical connector of claim 18, wherein said plurality of retention tabs is comprised of at least three retention tabs.

21. The electrical connector of claim 18, wherein at least some of said plurality of retention tabs are rectangular in cross-section.

22. The electrical connector of claim 18, wherein at least some of said retention tabs extend from the engagement surface and toward the wire receiving face a distance ranging from approximately 0.2–0.8 millimeters.

23. The electrical connector of claim 18, wherein said housing has a longitudinal axis and at least some of said plurality of retention tabs are positioned closer to said longitudinal axis of said connector than the other of said plurality of retention tabs.

24. The electrical connector of claim 18 wherein said housing includes a plurality of wire receiving openings and a plurality of tool openings formed therein.

* * * * *